United States Patent [19]

Buchanan

[11] 4,114,223

[45] Sep. 19, 1978

[54] MOP HAVING A REMOVABLE COVER

[76] Inventor: Ritchie Buchanan, P.O. Box 221, Seabrook, N.H. 03874

[21] Appl. No.: 795,191

[22] Filed: May 9, 1977

[51] Int. Cl.[2] ..... A47L 13/24

[52] U.S. Cl. ..... 15/228

[58] Field of Search ..... 15/114, 118, 147 R, 15/147 B, 147 D, 149, 220 R, 228, 229 AP, 229 B, 229 BC, 229 BP; 401/289

[56] References Cited

U.S. PATENT DOCUMENTS

| | | | |
|---|---|---|---|
| 1,568,100 | 1/1926 | Sturgis | 15/229 BP |
| 1,929,222 | 10/1933 | Thornton | 15/229 BP |
| 2,212,172 | 8/1940 | Veeck | 15/228 |
| 2,293,461 | 8/1942 | Gougeon | 15/247 |
| 2,669,741 | 2/1954 | Jelliffe | 15/229 BP |
| 2,831,207 | 4/1958 | Thompson et al. | 15/228 |
| 3,428,987 | 2/1969 | Loston | 15/247 X |

FOREIGN PATENT DOCUMENTS

| | | | |
|---|---|---|---|
| 236,990 | 7/1925 | United Kingdom | 15/247 |
| 318,025 | 8/1929 | United Kingdom | 15/228 |

*Primary Examiner*—Daniel Blum

[57] ABSTRACT

A mop comprising a frame having a center mounted pivotally attached handle rotatable through an interruption in the frame from one side to the other side of the frame, the mop also comprising a removable cover for the frame, the cover having cleaning surfaces on both sides and defining an envelope to receive the frame, a slot being provided on each side of the cover to permit movement of the handle therethrough upon rotation between the sides of the frame.

2 Claims, 3 Drawing Figures

MOP HAVING A REMOVABLE COVER

This invention relates to a cleaning mop and more particularly to a reversible mop.

It is a principal object of this invention to provide a mop with a center mounted handle which may be pivotally rotated from one side to the other and with a removable cover which does not interfere with the handle rotation. It is a further object of the invention to provide such a mop in which the cover presents a maximum cleaning surface on each side thereof. Yet a further object is to provide such a mop and cover which is exceedingly simple to manufacture.

In general the invention features a frame having a handle centrally pivotally mounted thereon. One edge of the frame is interrupted to permit rotation of the handle from one side of the frame to the other. A removable, generally rectangular mop cover is provided having cleaning surfaces on both sides. Slots are provided in the cover extending from the pivotal connection of the frame to the interruption in the frame edge. The handle thus may be rotated from one side of the frame to the other through the cover slots.

In preferred embodiments, the cover defines an envelope having an opening along one edge for receiving the frame, the slots extending to the one edge. Closure means are provided at the cover one edge adjacent the slots. The cover edge opposite the one edge comprises an integral fold of the cover material and the side edges of the cover are secured together.

Other objects, features and advantages of this invention will be apparent to those skilled in the art from the following detailed description of a preferred embodiment taken together with the accompanying drawings, in which.

Figure 1:
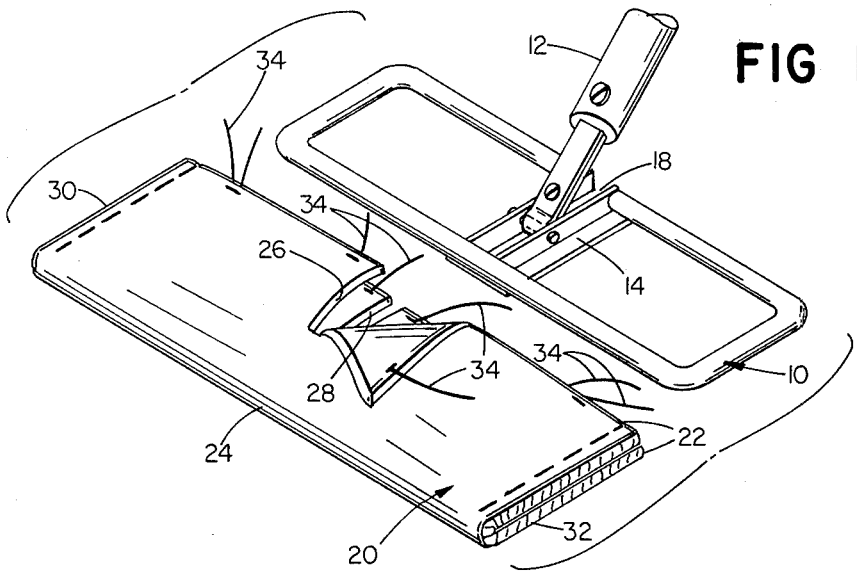
FIG. 1 is a fragmentary, exploded, isometric view of a mop frame and cover according to the invention.
Figure 2:
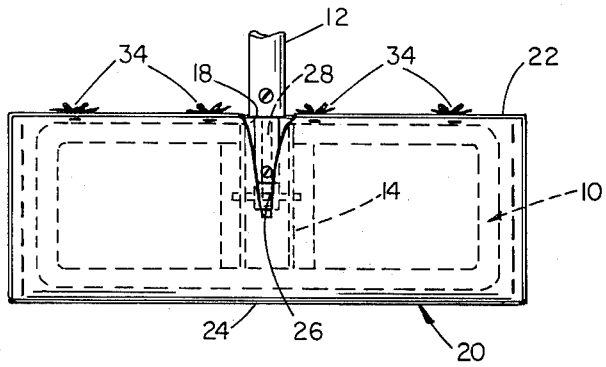
FIG. 2 is a fragmentary plan view of the frame and cover assembled.

As shown in FIG. 1, the mop comprises a tubular frame 10 having a handle 12 pivotally attached centrally thereof to a support structure 14 extending between the frame edges defined by the tubular frame 10. One edge 16 of the frame 10 is provided with an interruption 18 permitting handle 12 to pivot from one side to the other side of the frame.

Figure 3:
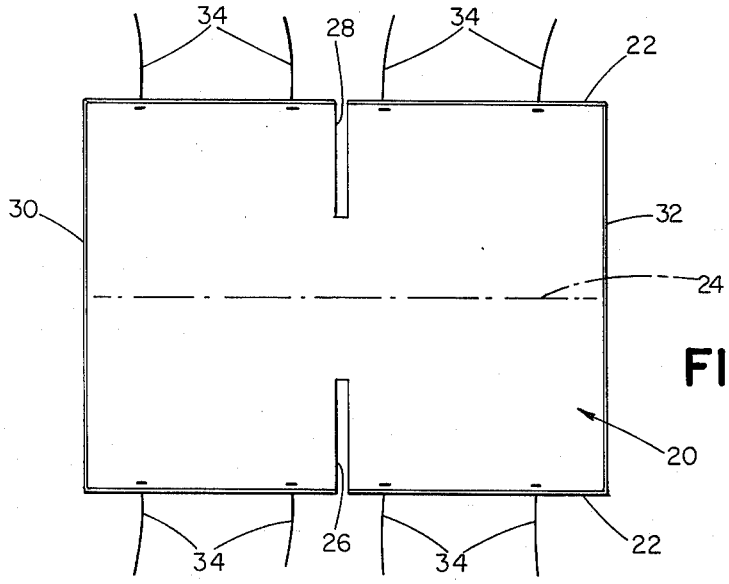
FIG. 3 is a plan view of the mop cover opened prior to stitching in its finished form.

The mop also comprises a fabric cover 20. As illustrated in FIG. 1, the cover 20 is formed into a generally rectangular envelope folded from a precut piece illustrated in FIG. 3. One edge 22 of the cover is open to receive frame 10, the other edge 24 comprising an integral fold of the fabric. The cover 20 defines a cleaning surface on each side thereof. Slots 26,28 are provided on each side of the cover extending centrally therefrom to the one edge 22 thereof. The side edges 30,32 of the cover are stitched together. Fastener ties 34 are positioned on each side of the slots 26,28 to secure the cover surfaces together and to retain the cover on the frame.

In use, the frame 10 is inserted within the cover 20 with handle 12 extending through one of the slots 26,28. Ties 34 are fastened together to secure the cover on the frame 10. If the cover surface needs to be reversed, the mop is simply turned over and the handle 12 pivoted through slots 26,28 to the other side of the mop. To replace the cover 20, the ties 34 are unfastened, the cover 20 removed from the frame 10 and a new cover is placed on the frame.

Advantageously, a center supported mop is provided which is reversible without removal of the mop cover and without interference of the cover with the pivotally attached handle.

Other embodiments of this invention will occur to those skilled in the art which are within the scope of the following claims.

What is claimed is:

1. A mop comprising a frame, a handle and a removable, generally rectangular mop cover, said handle pivotally connected to said frame centrally thereof, said frame defining one edge having an interruption to permit pivotal rotation of said handle from one side of said frame to the other side thereof, and said cover removeably mounted on said frame and having cleaning surfaces on both sides of said frame, the improvement in which said mop cover comprises an integral fold of cover material with said fold positioned opposite said one side of said frame, the side edges of said material extending between said fold and said one side of said frame being permanently secured together, said cover defining an envelope and having an opening along the one edge opposite said fold to permit removal of said cover from said frame, said cleaning surfaces of said cover on both sides of said frame each having a slot extending from said pivotal connection of said handle to said one edge in line with said interruption of said frame to permit rotation of said handle through said slots, and closure means at said cover one edge adjacent said slots for closing said envelope about said frame.

2. A mop cover adapted for removable mounting on a frame having a handle pivotally mounted centrally thereof and adapted for movement from one side to the other side of said frame, said cover comprising a generally rectangular envelope having cleaning surfaces on both sides thereof, said cover open along one edge to permit insertion of said frame therein, said cover surfaces joined on the edge opposite said one edge and comprising an integral fold of cover material, said cover surfaces permanently secured together at their side edges extending between said fold and said one edge, said cover surfaces each provided with a slot extending centrally therefrom to said cover one edge to permit said mop handle to extend through said slots when said handle is rotated from one side of said frame to the other side thereof; and closure means provided at said one edge adjacent said slots for closing said cover about said frame.

* * * * *